US006186270B1

(12) United States Patent
Roller et al.

(10) Patent No.: US 6,186,270 B1
(45) **Date of Patent: *Feb. 13, 2001**

(54) LAYERED SOUND ABSORBER FOR ABSORBING ACOUSTIC SOUND WAVES

(75) Inventors: Manfred Roller, Niederstotzingen; Klaus Pfaffelhuber, Günzburg; Stefan Lahner, Krumbach; Gerhard Köck, Waltenhausen, all of (DE)

(73) Assignee: M. Faist GmbH & Co. KG, Krumbach (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/765,011

(22) PCT Filed: Aug. 29, 1995

(86) PCT No.: PCT/EP95/03401

§ 371 Date: Dec. 17, 1996

§ 102(e) Date: Dec. 17, 1996

(87) PCT Pub. No.: WO96/08812

PCT Pub. Date: Mar. 21, 1996

(30) Foreign Application Priority Data

Sep. 14, 1994 (DE) ..... 94 14 943 U

(51) Int. Cl.[7] ..... E04B 1/82
(52) U.S. Cl. ..... 181/286; 181/290
(58) Field of Search ..... 181/284, 286, 181/288, 290, 291, 292, 293, 294, 295

(56) References Cited

U.S. PATENT DOCUMENTS 3,087,571 4/1963 Kerwin, Jr. .
3,087,573 4/1963 Ross .
3,439,774 4/1969 Callaway et al. .
4,479,992 * 10/1984 Haeseker et al. ..... 181/288 X
4,705,139 * 11/1987 Gahlau et al. ..... 181/290
4,782,913 * 11/1988 Hoffmann et al. ..... 181/286
4,825,974 * 5/1989 Hoffmann et al. ..... 181/209
4,867,271 * 9/1989 Tschudin-Mahrer ..... 181/290
5,153,388 * 10/1992 Wittenmayer et al. ..... 181/290

FOREIGN PATENT DOCUMENTS 2 671 899 7/1992 (FR) .

* cited by examiner

*Primary Examiner*—Khanh Dang
(74) *Attorney, Agent, or Firm*—Wallenstein & Wagner, Ltd

(57) ABSTRACT

A layered absorber for absorbing acoustical sound waves comprising a plurality of layers with at least one layer being spaced apart from another layer by spacers, and at least one layer having a thickness between 0.01 and 5 mm, such spacers being spaced apart from each other between the layers such that gas-filled chambers are formed, wherein the chambers form resonance chambers for acoustic sound waves by tuning the mass-spring pairs of the resonance chambers such that one maximum per mass-spring pair appears in the absorption curve, and wherein a multiple of parallel resonance chambers of a variety of different dimensions of the parallel resonance chambers are formed by varying at least one of the lateral dimensions of the parallel resonance chambers, the densities of the materials of the walls of the parallel resonance chambers, the thicknesses of the walls of the parallel resonance chambers, the rigidity of the materials of the walls of the parallel resonance chambers, the thicknesses of the walls of the parallel resonance chambers and the heights of the parallel resonance chambers in order to reach different sound absorptions in the respective absorption spectra.

11 Claims, 4 Drawing Sheets

LAYERED SOUND ABSORBER FOR ABSORBING ACOUSTIC SOUND WAVES

TECHNICAL FIELD

The invention relates to a sound absorber for absorbing acoustic sound waves.

BACKGROUND OF THE INVENTION

It has already been known to prevent sound waves from propagating into the environment right at the site of their occurrence, if possible, so that the environment is not affected too strongly by those acoustic sound waves. In order to form quiet spaces, it is further known to prevent, as far as possible, the sound from penetrating into those spaces from outside. Sound absorbers, which most of the time comprise sound absorbing materials, i.e. so-called "insulating materials" serve this purpose. However, material consumption is relatively high, which not only affects the production costs, but also the disposal of such insulating materials.

From DE 92 15 132 U1, there is known a molded part for use in the engine compartment of motor vehicles, which absorbs air sound and consists of a foil layer and a porous insulating layer. The molded part consists of an open porous PU foam which is sealed off by a PU foil on all sides.

Moreover, there are known sound absorbers (DE-U-92 15 132, DE-C-3 039 651, 4 011 705, 4 317 828 and 4 334 984) which comprise sound absorbing molded parts made of closed cellular PP foam, PE fleece bonded with a binder, polymeric materials or the like; uncovered Helmholtz resonators have also been used.

A sound absorber for absorbing sound from a relatively large frequency spectrum has also been known from U.S. Pat. No. 3,439,774, for instance. Therein, two layers are spaced apart from each other by a honeycombed spacer and provision is made for that the layers comprise micropores. The micropores are to be dimensioned according to a particular selection rule: the porosity of the outer layer, which faces the incident sound, shall comprise a relatively high permeability, i.e. penetrability for sound waves, and the other layer, which faces away from the incident sound, is to comprise a relatively low sound permeability. Such layers consist of stainless steel having a pore size of 50 to 500 $\mu$m, for instance.

Another problem, namely the muffling of body sound, i.e. the muffling of sound generating body portions, is also resolved in that muffling masses like those being spaced apart by spacers are applied onto the body which vibrates and therefore generates sound waves according to U.S. Pat. No. 3,087,571 and 3,087,573 as well as FRP 2 671 899, for instance.

SUMMARY OF THE INVENTION

It is the object underlying the invention to improve a sound absorber of the type specified at the beginning to the effect that as high as possible sound absorption is realized at an as low as possible material expenditure.

The invention is characterized in claim 1 and preferred embodiments are claimed in the subclaims. The following specification also relates to preferred embodiments.

According to the invention, the sound absorbing component consists of a sequence of layers having different densities and degrees of rigidity, which layers may optionally be laterally interrupted or, respectively, separated by webs and spacers. These layers consist of foils, fleeces, foams, other membrane-like materials or fabrics or a gas, which may expediently be air too. It is essential for the acoustic efficiency of the component that the successive layers differ from each other quite clearly, i.e. almost abruptly, in respect of their density and rigidity. At suitable dimensioning, this results in reflections of the sound waves travelling to and fro in the absorber at transition portions, which leads to good sound absorption in specific, preselectable frequency ranges.

Moreover, it is advantageous to laterally limit this layer system by webs or, respectively, pinched-off portions and spacers. This makes it possible to fix the individual materials and to realize different material sequences and, accordingly, different sound absorptions in the corresponding frequency ranges (absorption spectra).

One of said layers may expediently be configured as a carrier layer, i.e. a carrier body having a high mass, in particular.

The carrier body may then be configured as a shell-like or, respectively, tub-like carrier shell while the spacers or the intermediate layers, which keep further thin layers spaced apart from the carrier shell, are configured and arranged such that resonance chambers are formed between the layers and the carrier shell.

In contradistinction to those sound absorbers which are used most frequently and wherein the spaces between the layers are filled with insulating materials, said spaces remain largely material-free in accordance with the invention. Namely, the sound absorbing effect is predominantly achieved by that the gas modules between the layers are made to vibrate by the incident sound waves. The gas modules, which consist of air in particular, have a surface-related rigidity which constitutes a ass-spring system together with the mass coatings of the layers and the surrounding air coupled thereto, which system results in acoustic impedance minima and, accordingly, to sound absorption in the range of the resonance frequencies.

Thus, the absorber may be realized by a successive connection of masses and springs. One acoustic impedance minimum per mass-spring pair appears at the absorber surface, which in its turn results in a resonance in the absorption curve of the component concerned. These resonance frequencies may be varied by varying the material thicknesses and densities and any absorption course may thereby be realized.

It is preferred to select the carrier layer from a material which distinguishes itself by the following properties above all:

It is recommended to produce the carrier layer via deep-drawing or transfer molding or similar non-machining molding processes; press-forming of fibrous structures, in particular, is suitable as well. It is recommended that the carrier layer surfaces, which face away from the resonance chambers, be adapted to those contours which face the visible side of the sound absorber, i.e. the passenger compartment of a motor vehicle, for instance. Thus, the carrier layer may for instance represent the dashboard of the motor vehicle in order to prevent sound waves being generated in the engine compartment from penetrating into the passenger compartment.

Thus, the carrier layer may also be constituted by a component which is necessary anyway, e.g. a partition wall of sheet metal so that the sound absorber does not need a further carrier shell even if it preferably constitutes an integrated assembly which is prefabricated and installed as an integrated assembly at the site of employment.

The layers should comprise a thickness in the range of 10 $\mu$m –5 mm. It is particularly recommended to use a polyurethane elastomer (PU), polypropylene (PP) and/or polyester (PET) for the layers. It is also recommended to produce the layers from carbon, PAN (polyacrylonitrile) or natural fibers and/or from fiber-reinforced thermoplastic or mixtures thereof. More particularly, flax, coir, sisal, jute, hemp or cellulose may be used as natural fiber materials, which may be bonded thermoplastically, pressed more or less strongly or bonded with natural binders, e.g. lignine or starch.

The spacers should be spaced apart from each other between the carrier layer and the further layers such that the resonance chambers are respectively closed by the carrier shell at one end and by one of the layers at the other end or between the layers proper, respectively. It may be expedient for special cases to provide the layers with openings leading towards the resonance chambers; the carrier layer may comprise openings as well.

Very simple spacers are formed by web-shaped or plate-shaped supports extending between the layers and being disposed substantially perpendicularly in respect of these; the spacers may also extend towards these aggregates of the sound absorber under angles deviating therefrom if this is useful for reasons of space, such as for accommodating further components such as electrical components, or for resonance purposes.

The spacers consist of PU (polyurethane elastomer), PET (polyester), PP (polypropylene), carbon, PAN (polyacrylonitrile) or natural fibers and/or fiber-reinforced thermoplastic or, respectively, mixtures of these fibers, similar to the material composition of these layers. Just like the thin layers, the spacers may also consist of fleece, foamed material or foil.

According to a preferred embodiment of the invention, the spacers consist of a foamed material of polyurethane elastomer (PU) or a PET (polyester) fleece; in this case, the spacers themselves contribute to sound absorption, namely in the form of a combination between the "layered absorber" and the "insulating material absorbers". Due to this combination, certain frequency spectra of sound absorption may be "customized", as it were.

According to another preferred embodiment of the invention, the spacers consist of a deep-drawn material which more particularly consists of the same material as either the layers or the carrier layer. If the deep-drawn material itself is effective as a chamber resonator or, when openings are provided, as a Helmholtz resonator, there results a combination between the layered absorber and these absorber types. Moreover, the chamber is protected against dirt in the Helmholtz resonator, in particular (see FIG. 3). If chambers are produced from the material in the deep-drawing process, which are equally effective as resonance absorbers via variation of the chamber dimensions, as is known, there results a combination of chamber and layered absorber. Thus, it is recommended to combine the deep-drawn spacer with the layers and to insert this assembly in the carrier shell in order to form the integrated sound absorber component. It is recommended to secure the layer edge to the edge of the carrier shell, more particularly via bonding.

In the following, some embodiments of the invention will be described in detail upon reference to the drawing; therein

DETAILED DESCRIPTION OF THE PREFERRED EMBODIMENT

Figure 1:
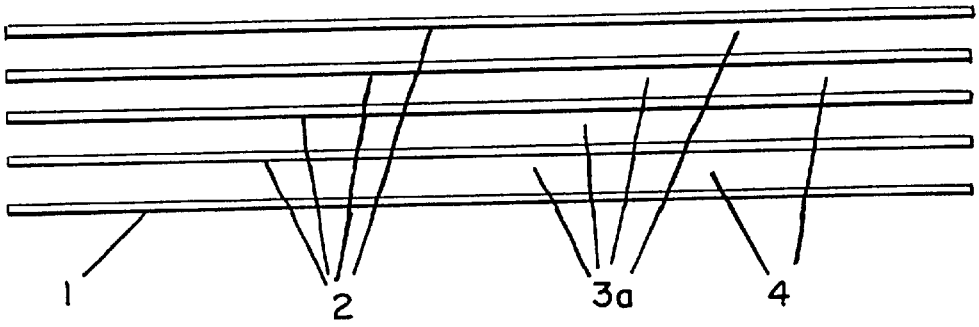
FIG. 1 shows a sequence of different layers in a schematic sectional diagram.

FIG. 1 shows an embodiment including a sequence of respective thin layers 2 or membranes (foil, fleece, foamed material etc.) together with the corresponding intermediate layers 3*a*. These intermediate layers 3*a* form simple resonance chambers 4 which may be filled with gas and air, in particular. The system is enclosed by a layer 1 having a high mass like the one formed by a carrier shell of an engine case, for instance.

Figure 2:
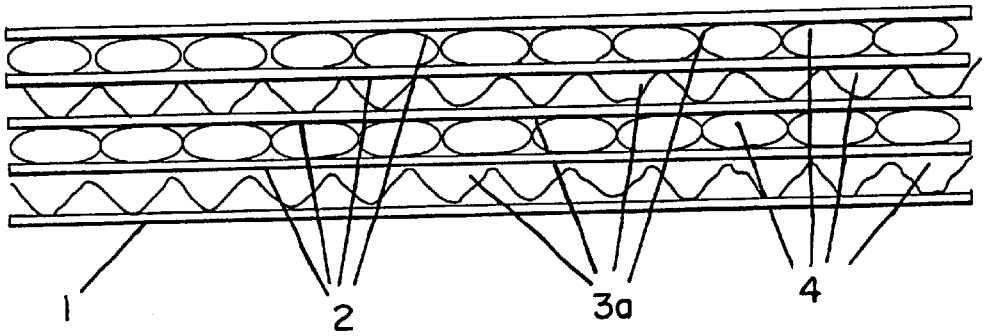
FIG. 2 shows a sequence of different layers and intermediate layers or spacers, respectively.

FIG. 2 shows an alternative embodiment of FIG. 1, wherein spacers 3*a*, i.e. the intermediate layers, consist of a porous absorber material, e.g. foam or fleece material. Instead of the air layers, it is these materials which increase the attenuation of the resulting resonances, which results in a broader absorption curve in the range of the resonance maxima concerned.

Figure 3:
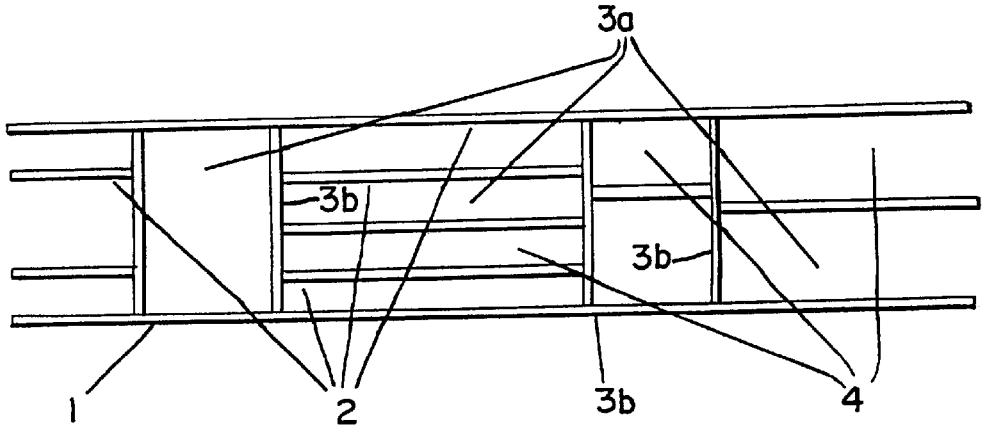
FIG. 3 shows a system of membrane and air layers which are laterally delimited by webs.

FIG. 3 shows a system consisting of layers 2 (membranes) and intermediate layers 3*a* (air) which is laterally delimited by spacers 3*b* which are configured as supports, more particularly, support walls or webs, respectively. These spacers 3*b*, which are advantageously integrally connected to the carrier layer 1 serve to fix the individual layers 2. Thus, there may further be realized different layer sequences at different locations, whereby resonance chambers 4 of different sizes are created. This provides for a variety of possible absorption spectra.

Figure 4:
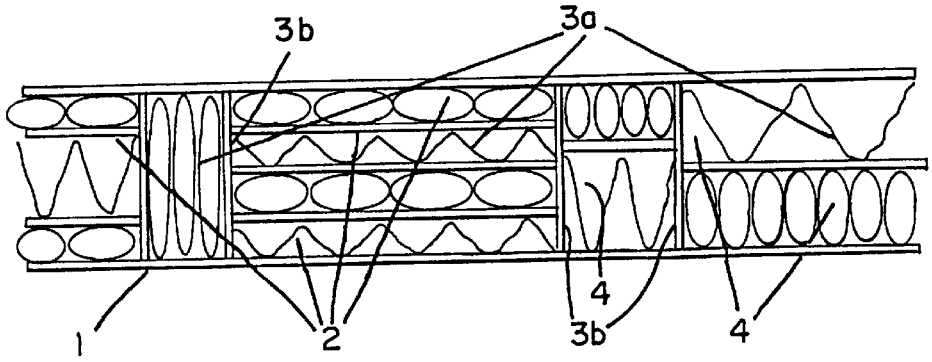
FIG. 4 shows a system of membrane and air layers which are delimited by webs.

FIG. 4 shows an alternatve embodiment of the system according to FIG. 3, intermediate layers 3*a* consisting of fleece or foam, respectively, and fulfilling similar tasks as in FIG. 2.

Figure 5:
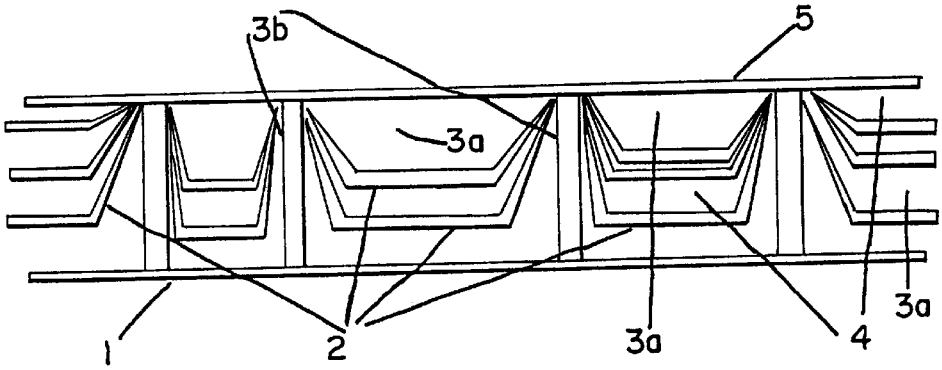
FIG. 5 shows a layer sequence of membranes as thin layers molded via thermoforming or hot pressing.

FIG. 5 shows a layer sequence of layers 2 (membranes) molded via thermoforming or (hot) pressing etc., which are applied onto corresponding spacers 3*b* (webs). Different layer spacings may be realized via different degrees of deformation. This creates differently large resonance chambers 4 which equally ensure a large variety of possible absorption spectra according to location and position.

Figure 6:
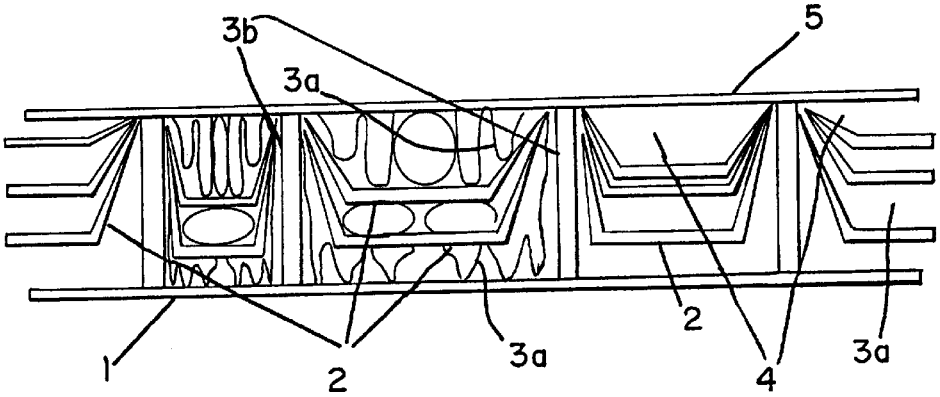
FIG. 6 shows a layer sequence of membranes molded via thermoforming or hot pressing together with corresponding intermediate layers or spacers, respectively.

In analogy with the previous embodiments, FIG. 6 shows a system according to FIG. 5, the corresponding intermediate layers 3*a* consisting of corresponding fleeces, foams or foils for attenuating the corresponding resonance maxima.

Figure 7:
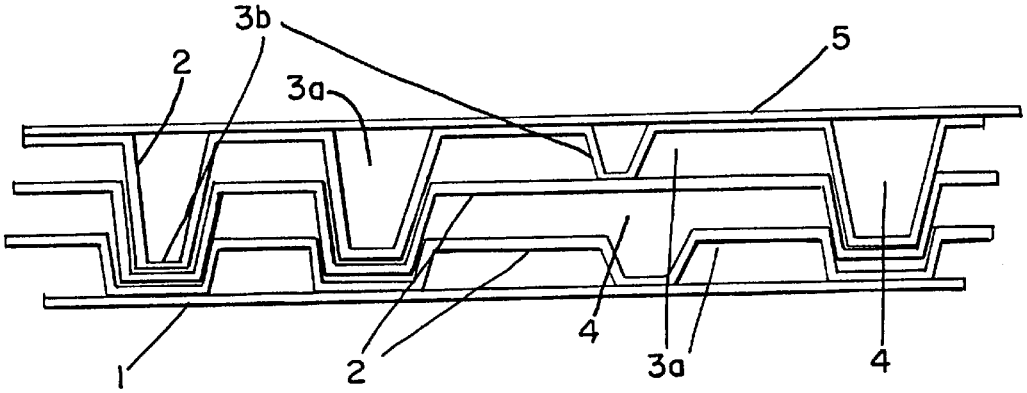
FIG. 7 shows a system of superimposed absorber chambers.

According to FIG. 7, the absorber consists of a superimposed structure of absorber chambers 4 which together are covered by a largely planar cover membrane 5 or cover foil, respectively. Between absorber chambers 4, there are disposed thin layers 2 which may be connected to cover membrane 5 and carrier shell 1 at specific locations. This additional cover layer improves absorption due to its additional acoustic efficiency. Instead, it may also be sufficient to merely build up one single layer of absorption chambers 4 on carrier layer 1 and cover it with a cover foil as the thin layer 2.

Figure 8:
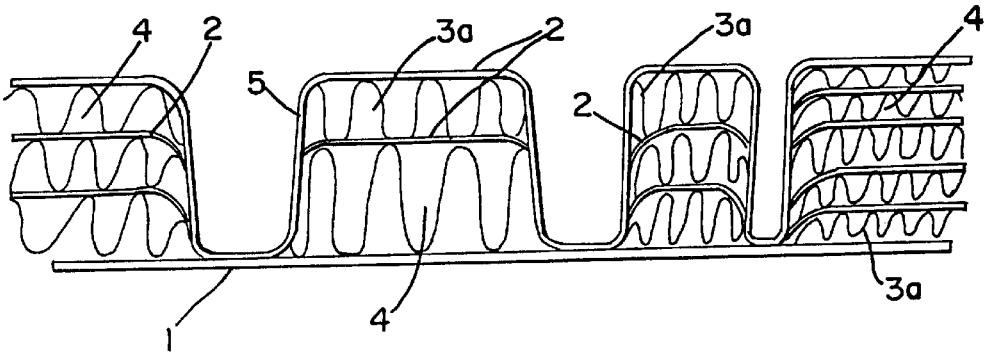
FIG. 8 shows a layer system comprising layers being laterally pinched off or welded to the carrier shell.

FIG. 8 shows a layer system consisting of layers 2 which are fixed to carrier layer 1 via lateral pinching off or welding. This embodiment is above all recommended for a sequence of foil, fleece, foil, fleece (e.g. PES foil, PET fleece . . . or PP foil, PP fleece . . . ) or foil, foam, foil, foam (e.g. PU foil, PU foam, PU foil, PU foam) or also for a sequence of fleeces having different degrees of compaction. One single material type may be employed for reasons of recycling and environmental protection.

Figure 9:
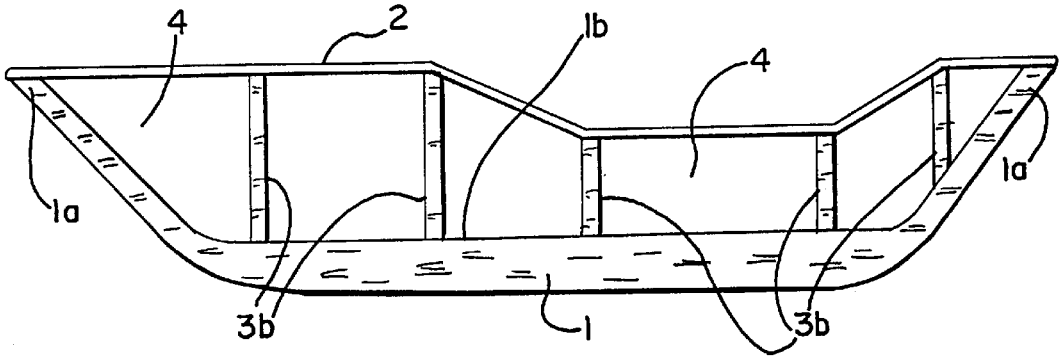
FIGS. 9/9*a* shows schematic cross-sections through sound absorbers together with plate-shaped spacers.

According to FIG. 9, carrier shell 1 is configured to be tub-shaped; it consists of GMT, for instance, and has been prefabricated in a deep-drawing process. Plate-shaped spacers 3*b* extend from the inside 1*b* of carrier shell 1 substantially perpendicularly towards the plane of carrier shell 1 up to the location where they serve to support the foil which is stretched thereon as a thin layer 2. At its edge, the foil is adhered to the edge 1*a* of carrier shell 1. The foil is tightly stretched. Resonance chambers 4 are formed between carrier shell 1 and the foil. The foil consists for instance of polypropylene whereas spacers 3*b* consist of the same material as carrier shell 1 and may also be produced integrally therewith in a transfer molding process, for instance.

Figure 9A:
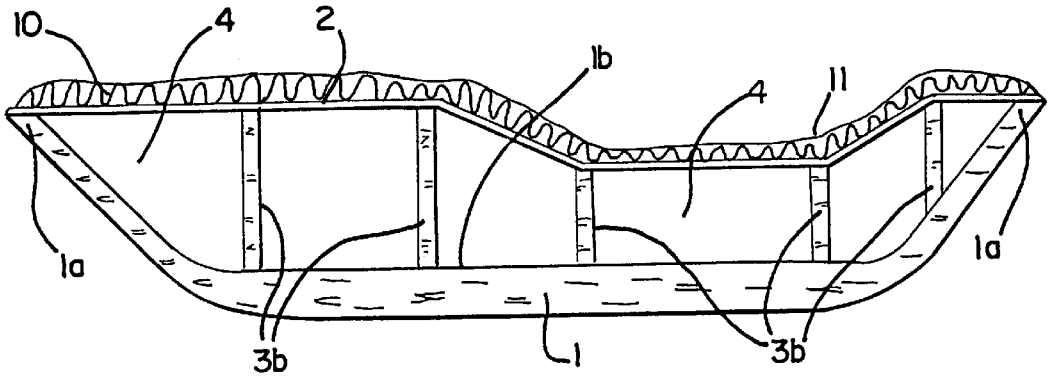

According to FIG. 9*a*, thin layer 2 is coated with a thin foam layer or fleece layer 10 and a thin cover foil 11 or a thin cover fleece in order to improve absorption at high frequencies.

Figure 10:
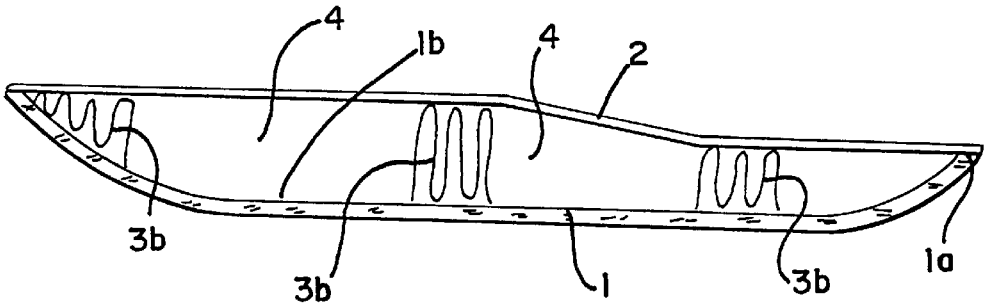
FIG. 10 shows a corresponding schematic cross-section through the sound absorber with foamed material for the spacers.

According to FIG. 10, carrier shell 1 is produced from GMT, for instance, and molded into the shell-like shape, which is shown here, in a pressing process. On the inside 1*b* of carrier shell 1, there are incorporated spacers 3*b* in the form of foam material strips of a polyurethane elastomer and/or polyester fleece to be spaced from each other. The width thereof is substantially less than the spacing thereof so that the resonance chambers 4 are formed between carrier shell 1 and the foil or, respectively, the thin cover layer 2 stretched over spacer 3*b* and edge 1*a* of carrier shell 1.

Figure 11:
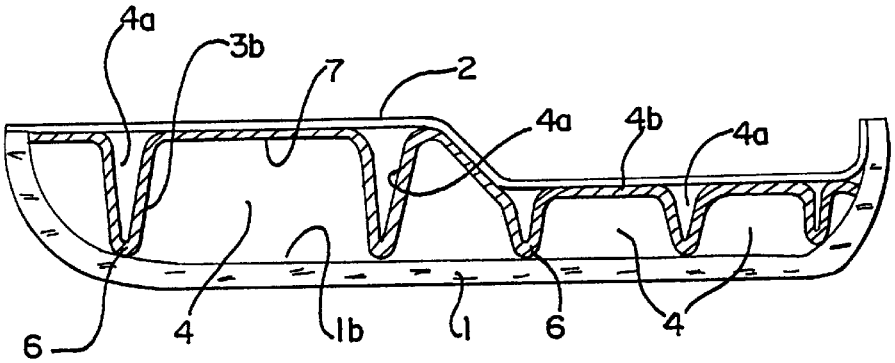
FIG. 11 shows a schematic view of an alternative configuration of the invention wherein the absorber chambers of deep-drawn material are coated with a thin layer or membrane, respectively.

According to FIG. 11, carrier shell 1 is a deep-drawn tub-like component of GMT, for instance. On the inside 1*b*, the tips 6 of spacers 3*b* are attached, which are connected to each other in that they constitute a deep-drawn component of polypropylene, in particular.

On the side facing away from tips 6 of spacers 3*b*, the thin layer 2, e.g. a fleece is drawn along. In this embodiment of the invention, resonance chambers 4 on the side facing away from carrier shell 1 are not only covered by layer 2, but also by webs 7 which connect spacers 3*b*. Helmholtz resonators may be created by providing openings 4*b* in connecting webs 7. Openings 4*b* are covered by layer 2 and thus resonance chambers 4 are protected against dirt. In case cover layer 2 and spacers 3*b* have not been produced from the same material like polypropylene (PP), which favors disposal, the mass coating may be adapted to the desired resonance frequency by selecting a different material or, respectively, by varying the material thickness. If the same material is used, better resonance frequency adaptation may be achieved by varying the material thickness. Within spacers 3*b* there are formed further chambers 4*a* which are covered by the fleece or a foil towards the one side only and which may therefore act as a layered resonator.

Thus, the sound absorber according to the invention constitutes a layered resonance absorber wherein the layer sequence is preferably structured and dimensioned via successive and, optionally, parallel connection such that one maximum per mass-spring pair appears in the absorption curve.

We claim:

1. A layered absorber for absorbing acoustical sound waves comprising a plurality of layers with at least one layer being spaced apart from another layer by spacers, and at least one layer having a thickness between 0.01 and 5 mm, such spacers being spaced apart from each other between said layers such that gas-filled chambers are formed, wherein said chambers form resonance chambers for acoustic sound waves by tuning the mass-spring pairs of said resonance chambers such that one maximum per mass-spring pair appears in the absorption curve, and wherein a multiple of parallel resonance chambers of a variety of different dimensions of said parallel resonance chambers are formed by varying at least one of the lateral dimensions of said parallel resonance chambers, the densities of the materials of the walls of said parallel resonance chambers, the thicknesses of the walls of said parallel resonance chambers, the rigidity of the materials of the walls of said parallel resonance chambers, and the heights of the said parallel resonance chambers in order to reach different sound absorptions in the respective absorption spectra.

2. The layered absorber of claim 1 wherein said spacers are web-shaped.

3. The layered absorber of claim 1 wherein said spacers are plate-shaped.

4. The layered absorber of claim 1 wherein said spacers are integrally formed with a shell-like carrier body forming one of said layers.

5. The layered absorber of claim 4 wherein said carrier body comprises a high mass.

6. The layered absorber of claim 4 wherein said carrier body and said spacers are integrally formed by transfer molding.

7. The layered absorber of claim 1 wherein said spacers are fabricated by a deep-drawn process.

8. The layered absorber of claim 1 wherein one of said layers is formed by a common cover foil disposed to span the resonance chambers over the whole sound absorber on the side facing the incident sound.

9. The layered absorber of claim 8 wherein the cover foil is made of polypropylene.

10. The layered absorber of claim 1 wherein on of the layers is made of fleece.

11. The layered absorber of claim 4 wherein said carrier body is tub-shaped.

* * * * *